United States Patent [19]

Sparling

[11] 3,999,580

[45] Dec. 28, 1976

[54] WEFT INSERTING RAPIER GUIDE MECHANISM FOR A SHUTTLELESS LOOM

[75] Inventor: Robert O. Sparling, Smithfield, R.I.

[73] Assignee: Cox Foundry & Machine Company, Atlanta, Ga.

[22] Filed: June 26, 1975

[21] Appl. No.: 590,639

[52] U.S. Cl. ..... 139/449

[51] Int. Cl.[2] ..... D03D 47/00

[58] Field of Search ..... 226/181, 182; 139/444, 139/445, 446, 449

[56] References Cited

UNITED STATES PATENTS

| | | | |
|---|---|---|---|
| 837,019 | 11/1906 | Whitmore | 139/123 |
| 1,957,024 | 5/1934 | Klemm | 139/449 |
| 2,818,882 | 1/1958 | Haberhauer | 139/123 |
| 3,122,173 | 2/1964 | O'Neill | 139/124 A |
| 3,364,954 | 1/1968 | Kokkinis | 139/122 R |
| 3,557,844 | 1/1971 | Libby | 139/124 A |
| 3,610,294 | 10/1971 | Maassen | 139/123 |
| 3,951,178 | 4/1976 | Simmons | 139/449 |

FOREIGN PATENTS OR APPLICATIONS

| | | | |
|---|---|---|---|
| 638,336 | 3/1962 | Canada | 226/182 |

*Primary Examiner*—Henry S. Jaudon
*Attorney, Agent, or Firm*—Walter M. Rodgers; Walter A. Rodgers

[57] ABSTRACT

Reciprocatory motive means is coupled with weft inserting rapier means, the movement of which into and out of the warp shed is controlled and guided by low friction swivel means which cooperates with the reciprocatory motive means in such manner as properly to position the rapier means relative to the loom lay on which the reciprocatory motive means, the rapier means and the swivel means are mounted.

6 Claims, 6 Drawing Figures

WEFT INSERTING RAPIER GUIDE MECHANISM FOR A SHUTTLELESS LOOM

Shuttleless type looms are commonly characterized by faster operation, less inertia and much less noise than looms of the shuttle type. Shuttleless looms in which rapiers are inserted from opposite ends of the shed and in which a weft thread is inserted by a rapier into one end of the shed and "handed off" to a rapier inserted from the opposite end of the shed must be characterized by precise control of the rapiers in order to insure efficient transfer of the weft yarn from one rapier to the other at a minimum failure rate. Furthermore since rapiers must be rapidly inserted and withdrawn from the warp shed there is a possibility that the rapiers might collide with each other or rub against the full width of the reed and in this manner to cause deleterious wear and overall general disruption of the operation of the rapier means and associated parts. If no provision is made so as precisely to guide the rapiers by use of low friction guide means and where reciprocatory rapiers are guided by rigidly mounted high friction guide means, the frictional relation between such fixedly mounted guide means and the reciprocatory rapier means itself constitutes a hazard to efficient operation and tends to increase the wear rate.

According to this invention, reciprocatory motive means is pivotally interconnected with the outer end of rapier means and is arranged so that the pivotal connection between the motive means and the rapier means reciprocates along a straight line and a low friction swivel means disposed along the path of reciprocatory movement of the rapier means is arranged to engage and guide the rapier means. Since the swivel means may change position somewhat during a rapier inserting and withdrawing operation, it is possible to control the movement and position of the rapier means throughout its cycle of operation. According to one facet of the invention, the pivotal connection between the reciprocatory motive means and the outer end of the rapier means moves along a straight line which is disposed at a slight angle to an imaginary line parallel to and spaced forwardly from the reed and by this means wearing engagement with the reed is avoided. The swivel means is provided with specially constructed low friction rollers which engage and secure the rapier means against substantial transverse movement and which also accommodate reciprocatory axial movement of the rapier means with a minimum of frictional resistance.

For a better understanding of the invention, reference may be had to the following detailed description taken in conjunction with the accompanying drawings in which FIG. 1 is a fragmentary perspective view of one side of the lay structure of the loom and shows the reciprocatory motive means, the rapier means and the swivel means constructed according to one form of this invention;

Figure 1:
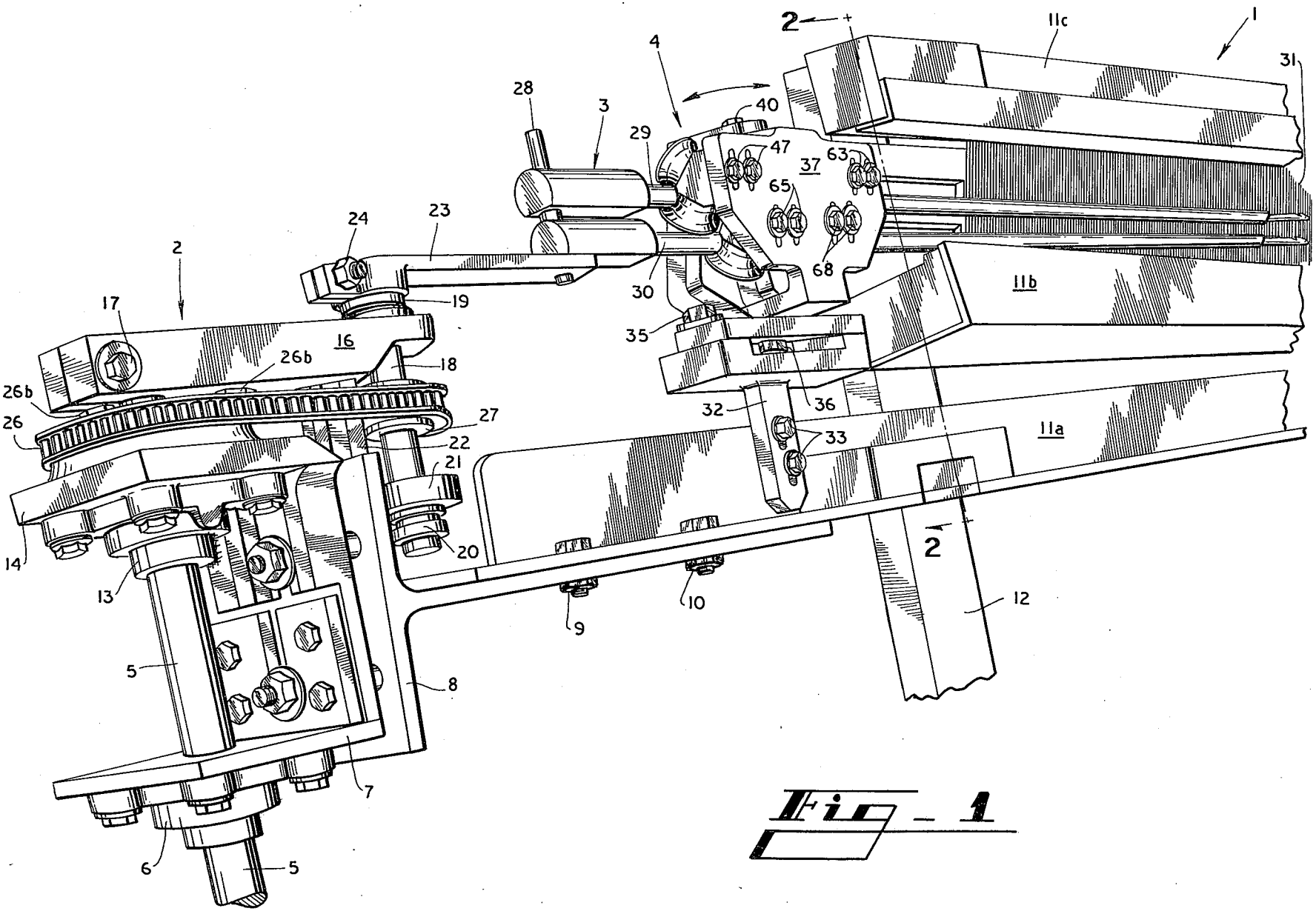

In the drawings the numeral 2 generally designates one end of the lay structure of a loom. The numeral 2 generally designates reciprocatory motive means which is operably connected with the rapier means generally designated by the numeral 3. The numeral 4 generally designates swivel means which cooperates with the rapier means to control the reciprocatory motion thereof during weft inserting and withdrawing operations.

Reciprocatory motive means 2 is driven by a rotatable generally vertically disposed operating shaft 5 which is journalled by means of bearing 6 mounted in support plate 7 which in turn is secured to support structure 8 mounted by bolts 9 and 10 to cross beam 11*a* which constitutes a part of the lay structure of the mechanism and which at one end is mounted on support element 12 for swinging movement relative to the shed and main body of the cloth to perform beat-up operations of weft threads inserted into the warp sheds. Shaft 5 is also journalled in bearing 13 mounted in plate 14 which forms a part of support structure 8.

Operating arm 16 is secured to the top end of operating shaft 5 by a clamping bolt 17. A stub shaft 18 is journalled by bearing 19 in the outer end of rotatable operating arm 16. Stub shaft 18 is also journally mounted in bearing 20 supported by plate 21 secured by vertical bar 22 to operating arm 16. Affixed to the upper end of stub shaft 18 is an operating crank 23, such securement being by way of the clamping action of bolt 24 so that rotation of stub shaft 18 is accompanied by rotation of crank 23.

Figure 4:
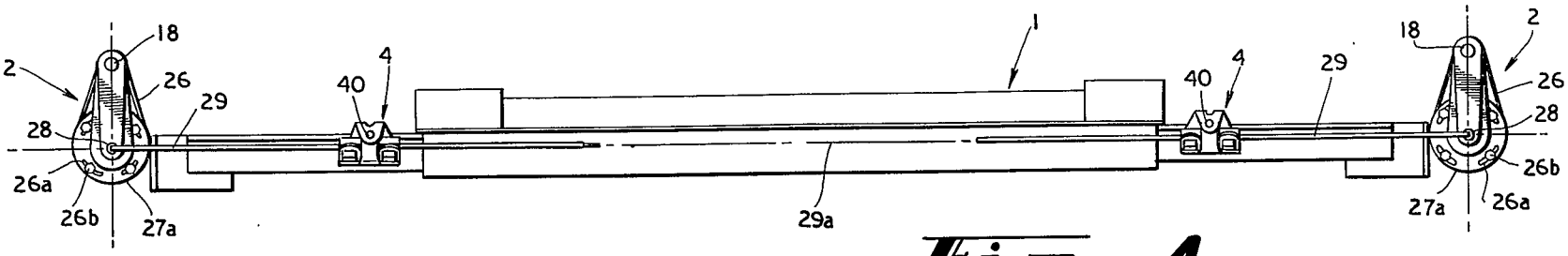
FIG. 4 is a schematic view of the lay structure of a loom as seen from above and which shows motivating means on opposite ends of the lay together with rapier means and swivel means constructed according to this invention and shows the structure at approximately the mid position of a rapier inserting or withdrawing operation.
Figure 5:
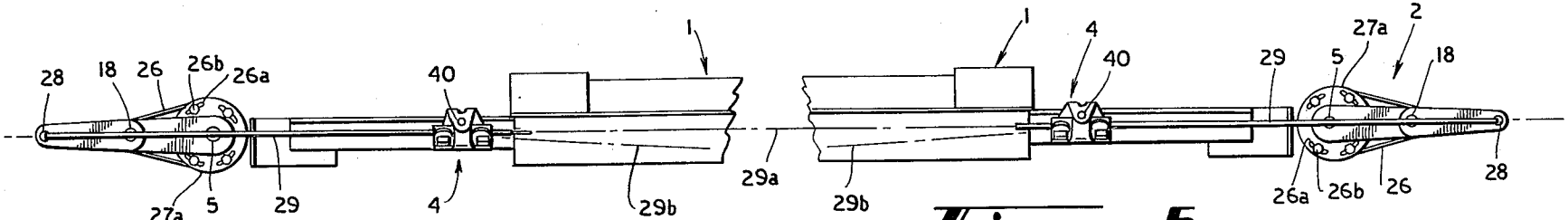
FIG. 5 is a view similar to FIG. 4 and depicts the structure at the beginning of a weft inserting cycle and FIG. 6 is a view similar to FIGS. 4 and 5 and depicts the structure at the completion of a rapier inserting operation and at the beginning of withdrawal movement.
Figure 6:
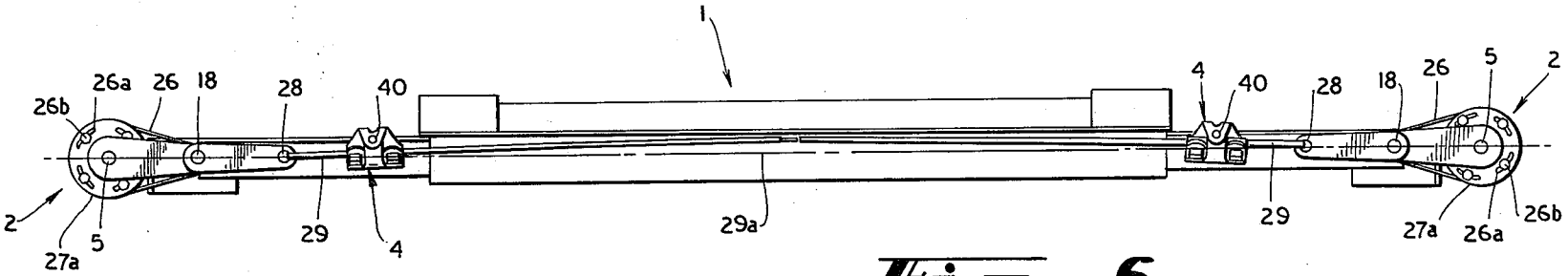

In order to impart rotary motion to stub shaft 18, an endless chain 26 is trained about a spocket 27 securely affixed to stub shaft 18 and in cooperative engagement with a sprocket 27*a* not shown in FIG. 1 but which is securely mounted atop the support plate 14 and which is schematically illustrated in FIGS. 4, 5 and 6.

Thus rotation of shaft 5 imparts rotary swinging movement to crank arm 16. Since sprocket 27 is affixed to shaft 18 and because chain 26 cooperates with the fixed gear or sprocket 27*a* mounted atop plate 14, swinging movement of arm 16 imparts rotary motion to stub shaft 18. Such motion thus imparts swinging movement to crank arm 23. In view of the above discussion, it is apparent that rotation of shaft 5 imparts rotation to arms 16 and 23 in opposite directions simultaneously and that the pivotal connection designated by the numeral 28 between the swing end of crank 23 and the outer ends of rapiers 29 and 30 is caused to reciprocate from left to right and vice versa along a straight line. By this means the rapier means comprising rapiers 29 and 30 reciprocate alongside the reed 31 disposed between the horizontal beams 11*c* and 11*b* which constitute parts of the lay structure of the loom. For a more complete description of the structure and operation of motive means 2 reference may be had to U.S. Pat. 3,335,760 issued Aug. 15, 1967.

It will be understood that structure similar to that shown in FIG. 1 is duplicated on the opposite side of the loom so that weft threads may be inserted by one set of rapiers such as 29 and 30 handed off to another set of rapiers not shown or vice versa.

While the invention is illustrated in the drawings in conjunction with two rapiers such as 29 and 30 for weaving double pile cloth in known manner, it will be understood that the invention is applicable to apparatus for weaving flat type fabrics as well as double fabrics in which case only one rapier such as 29 or 30 is employed on each side of the loom.

Figure 2:
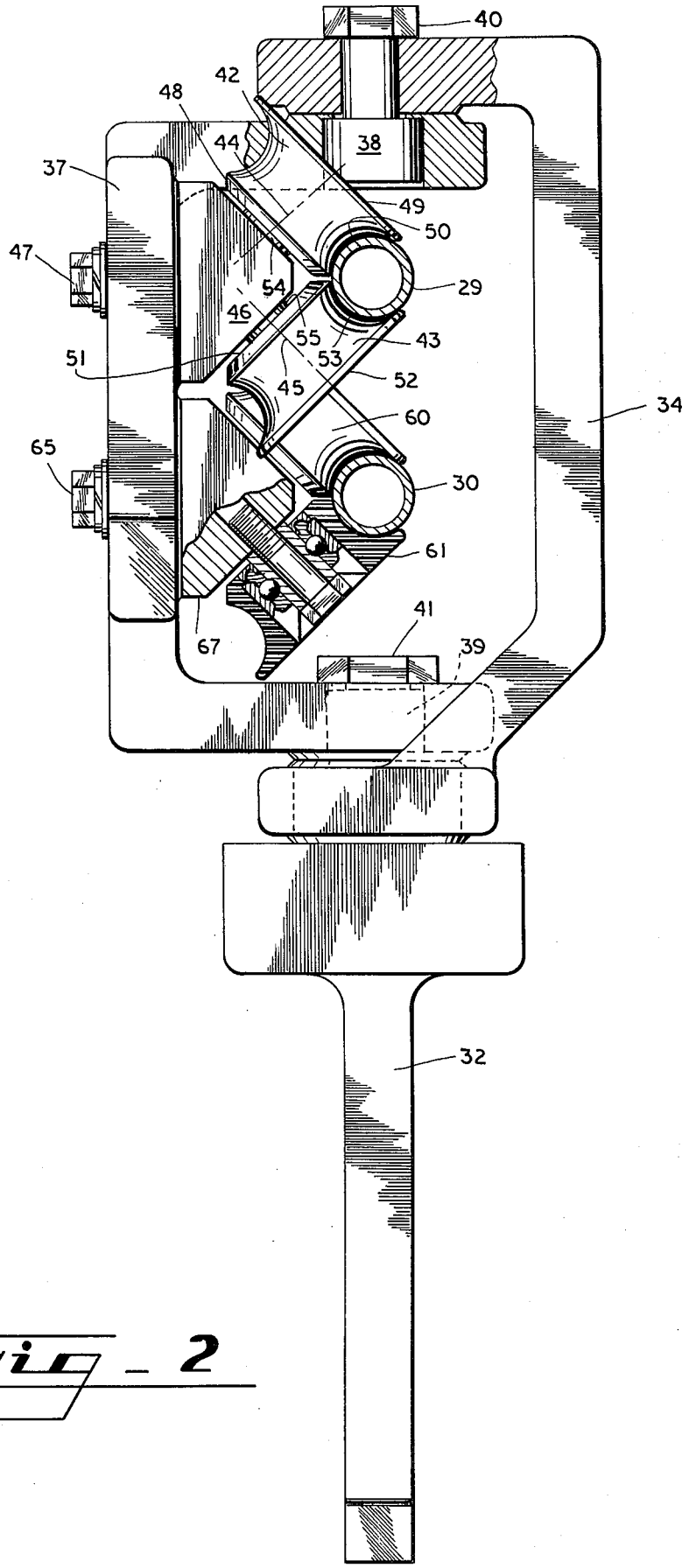
FIG. 2 is a cross sectional view of swivel means in a plane transverse to the rapiers.
Figure 3:
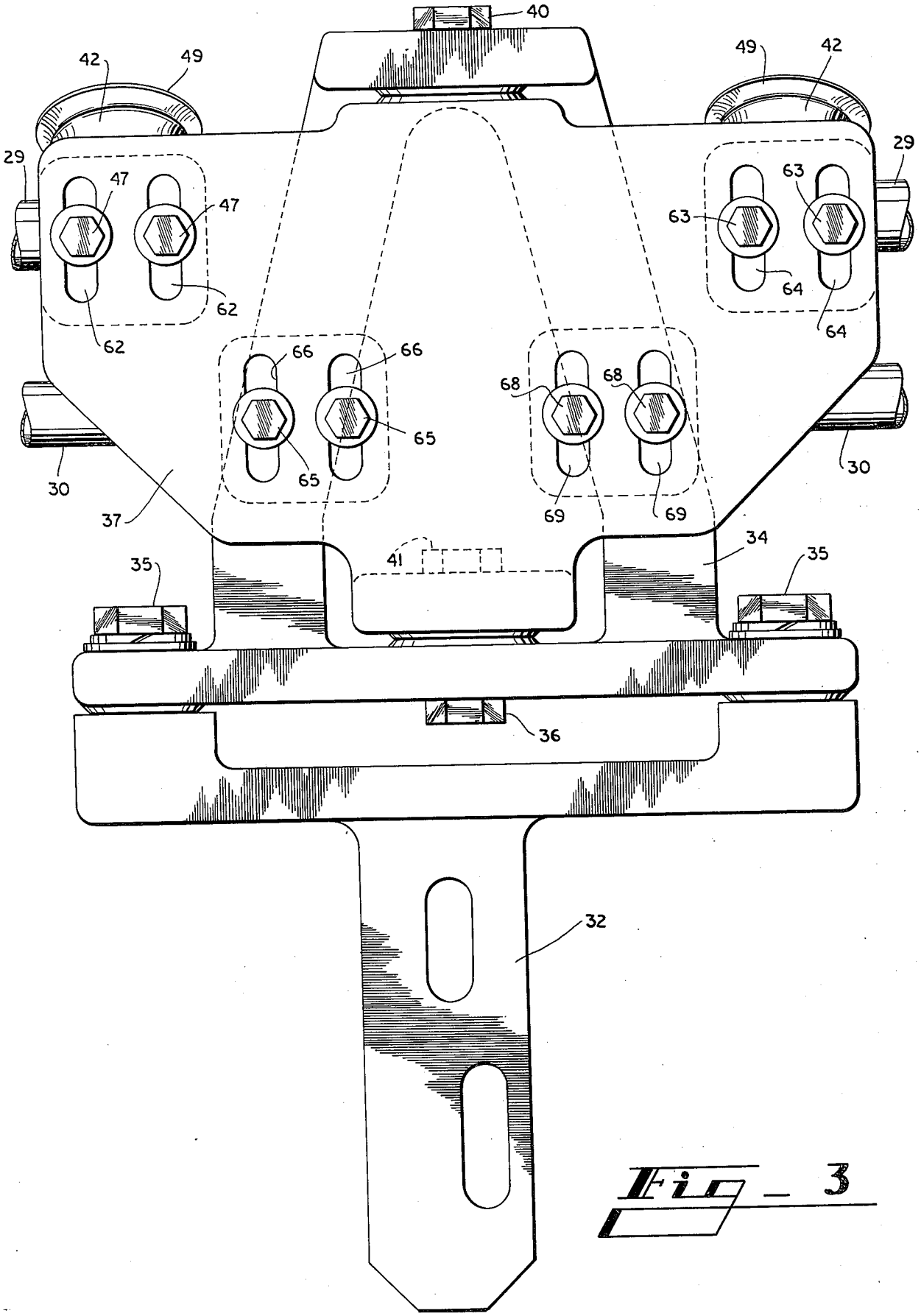
FIG. 3 is a front view of the swivel means as seen from the left hand side of FIG. 2 and from the front of FIG. 1.

For the purpose of guiding and controlling the reciprocatory motion of the rapier means, swivel means generally designated by the numeral 4 is provided in accordance with this invention. As is best shown in FIGS. 2 and 3, such swivel means comprises a mounting base which is fixed in position and supported by the lay of the loom. The mounting base comprises a mounting stud 32 secured by bolts 33 to beam 11*a* together with a fixed mounting bracket 34 secured to mounting stud 32 by bolts 35. As explained the mounting base is fixedly secured to the beam 11*a* of the lay.

For engaging in a manner properly to control and guide the reciprocatory movement of the rapier means, a swivel unit designated by the numeral 37 is pivoted at bearings 38 and 39 to the mounting base by means of bolts 40 and 41 respectively. Bearings 38 and 39 define a swivel axis which is transverse to the path of movement of rapier means 29, 30 and about which the swivel unit 37 may oscillate through a limited range of angular movement.

For the purpose of interrelating the swivel unit 37 with the rapier 29, low friction means is provided and comprises a pair of low friction rollers 42 and 43. These rollers are rotatable about shafts 44 and 45 respectively which in turn are rigidly secured to mounting block 46 secured by bolts 47 to the swivel unit 37 90° to each other. As is apparent from FIG. 2 one face 48 of roller 42 is of lesser diameter than is the opposite face 49. Furthermore an arcuate surface 50 defines the periphery of roller 42 and engages a part of the outer surface of the substantially round rapier rod 29. In like fashion one face of roller 43 designated by the numeral 51 is of lesser diameter than is the opposite face of roller 43 which is designated by the numeral 52. Furthermore arcuate periphery 53 of roller 43 engages a different part of the outer surface of the periphery of rapier 29 from that which is engaged by the arcuate surface 50 of roller 42. Of course rollers 42 and 43 are mounted on low friction bearings designated by the numerals 54 and 55 associated with shafts 44 and 45 respectively.

The axes of rotation of rollers 42 and 43 are angularly disposed to each other as is apparent from FIG. 2 and are disposed in a common plane which is generally parallel to the plane in which the swivel axis defined by bearings 38 and 39 is disposed. Furthermore it is apparent particularly from FIG. 2 that the arcuate portion 50 of the periphery of the roller 42 when added to or combined with the arcuate portion 53 of roller 43 together constitute a major and complementary part of the periphery of a cross section of rapier rod 29 so that rod 29 is effectively secured against transverse movement while allowed to reciprocate with very little frictional resistance due to the low friction bearing means 54 and 55 on which rollers 42 and 43 are mounted respectively.

The rapier 30 is engaged by low friction rollers 60 and 61 which are constructed and arranged in a manner identical to that described above in connection with rollers 42 and 43 so that a detailed description of the structure and mounting means of rollers 60 and 61 is not deemed necessary.

From FIGS. 1 and 3 it is apparent that the bolts 47 are disposed in vertical slots 62 so that vertical adjustment of mounting block 46 and of rollers 42 and 43 may readily be effected.

An additional set of rollers not shown in detail in the drawings is arranged to engage rapier 29. As shown in FIG. 3, supporting bolts 63 are adjustably mounted in vertically disposed slots 64. Bolts 63 constitute the means for holding support blocks identical to that designated by the numeral 46 and best shown in FIG. 2 and such structure cooperates with a pair of rollers identical to rollers 42 and 43 and a detailed showing and discussion of such rollers is not deemed necessary since it is apparent from FIGS. 1 and 3 that rapier 29 is engaged at two points along its axis and guided and controlled by structure such as that shown in FIG. 2.

In like fashion the bolts 65 which are adjustably mounted in slots 66 and which serve to support mounting block 67 on which rollers 60 and 61 are mounted correspond to similar support bolts 68 which are adjustably mounted in slots 69 to provide additional support for rollers which are identical to rollers 60 and 61 and which thus provide two points of engagement and guidance of rapier 30 as is apparent from FIGS. 1 and 3.

In FIG. 4 the rapier rods 29,30 are shown in the positions which these parts occupy at the mid point of a rapier inserting operation. In order to insure that the rapiers 29 and 30 do not collide or rub against the reed, control of movement of the rapier means is effected in accordance with a feature of this invention in such manner as to cause the rapier means to move in a direction away from the reed during the initial and intermediate stages of a rapier inserting operation as indicated in FIG. 5. Such movement causes the rapiers 29 and 30 to move without collision or abrasion against the reed and is accomplished by adjusting the relative position of sprockets 27*a* and sprocket 27 and by adjusting the swivel axis 39,40 of the swivel means slightly forward in a direction away from the reed. Relative adjustment of adjustable means in the form of sprockets 27 and 27*a* is effected by means of bolts 26*b* which are disposed in slots 26*a* to allow rotation of sprocket 27*a* relative to sprocket 27 preferably with the parts occupying the positions shown in FIG. 4. This action insures that the straight line motion of pin 28 across shaft 5 is in a somewhat divergent direction relative to the reed. With the parts adjusted in the above manner, movement of the rapiers in and out of the shed causes swivel means 37 to rotate in a clockwise direction about swivel axis 38,39 as indicated in FIG. 5 to insure that the inner ends of the rapier means 29,30 are moved outwardly somewhat from the adjacent parts of the reed 1 and in a divergent direction from an imaginary line 29*a* connecting the center of shaft 5 and parallel to and spaced forwardly from the reed as schematically indicated in exaggerated fashion by the imaginary lines 29*b* thus insuring that the rapier means may move in an unobstructed fashion completely clear of the reed. After the rapiers are fully inserted, the pins 28 will have moved to positions somewhat downwardly relative to the center of the axis of rotation of shaft 5 and such movement causes the swivel unit 37 to rotate in a counterclockwise direction about its swivel axis 38,39 to occupy the positions shown in FIG. 6. This position is precisely controlled and insures that the rapier means inserted from the left, for example, comes into precise and controlled coincidence with the rapier means inserted from the right to insure an efficient transfer of weft yarn with a minimum of failures and the inner ends of the rapiers are closer to the reed then as shown in FIG. 5.

It is apparent that this controlled movement of the rapier means 29,30 is effected according to one facet of the invention because the pivotal connection 28 between the reciprocatory motivating means 2 and the outer end of the rapier means 29,30 moves in a straight line which diverges slightly from the reed to cause the inner ends of the rapier means first to move in a direction downwardly and away from the reed as viewed in FIGS. 4, 5 and 6 and then upwardly somewhat to inscribe a generally arcuate path which insures smooth and efficient operation without abrasion, rubbing or collision with the adjacent reed and which at the same time insures precise positioning and registration of the inner ends of rapiers inserted from opposite sides of the loom thereby to effect efficient transfer of the weft yarn. Such action of course is possible due also in part to the swivel mounting and low frictional characteristics of the swivel unit 37 which itself is constructed according to one aspect of this invention.

The embodiments of the invention in which an exclusive property or privilege is claimed are defined as follows:

1. A rapier mechanism mounted on the lay of a shuttleless loom and movable adjacent the lay reed, said mechanism comprising rapier means including an elongated rod, reciprocatory motive means interconnected with the outer end of said rapier means by a pivotal connection which reciprocates along a straight line which diverges at a slight angle from the reed of the lay for inserting and withdrawing said rapier means into and out of a wrap shed, adjustable means for determining said slight angle, swivel means disposed in the path of movement of said rapier means and having a mounting base secured to the lay in spaced relation to the reed and a swivel unit arranged to swivel about a swivel axis which is fixed relative to the reed and transverse to the path of movement of said rapier means, and low friction means having a plurality of pairs of rollers rotatably mounted on said swivel unit and the axes of rotation of each pair of rollers being disposed at approximately 90° to each other said rollers being engageable with said rapier means for guiding the reciprocatory movement thereof so that the inner end of said rapier means moves away from said reed during the initial part of a rapier inserting operation and toward said reed during the final part of a rapier inserting operation, the axes of rotation of the rollers of each pair of said rollers being disposed in common planes respectively which are generally parallel to the plane in which said swivel axis is disposed and said pairs of rollers being spaced axially along said rod.

2. A rapier mechanism according to claim 1 wherein cross sections of the peripheries of said rollers at their points of contact with said rapier means are of arcuate configuration which together define a substantial part of a circle.

3. A rapier mechanism according to claim 1 wherein said rapier means comprises an elongated rod substantially round in cross section and wherein the peripheries of said rollers are of generally arcuate complementary configuration and wherein the diameter of one face of each of said rollers is substantially less than the diameter of the opposite face thereof.

4. A rapier mechanism according to claim 3 wherein the faces of lesser diameter of each of said rollers are disposed in close juxtaposition to each other.

5. A mechanism according to claim 1 wherein said rollers are adjustably mounted on said swivel unit.

6. A rapier mechanism according to claim 1 wherein said swivel means is caused to swivel about said swivel axis during reciprocatory movement of said rapier means.

* * * * *